United States Patent [19]

Hausknecht

[11] Patent Number: 4,483,283

[45] Date of Patent: Nov. 20, 1984

[54] VARIABLE VALVE CONTROL SYSTEM WITH DAMPENER ASSEMBLY

[76] Inventor: Louis A. Hausknecht, 4504 State Rd., Cleveland, Ohio 44109

[21] Appl. No.: 494,532

[22] Filed: May 13, 1983

[51] Int. Cl.[3] ..... F01L 1/24

[52] U.S. Cl. ..... 123/90.46; 123/90.16; 123/90.43

[58] Field of Search ..... 123/90.15, 90.16, 90.43, 123/90.46

[56] References Cited

U.S. PATENT DOCUMENTS

| | | | |
|---|---|---|---|
| 1,696,984 | 1/1929 | Trbojevich . | |
| 1,876,735 | 9/1932 | Noble . | |
| 1,914,340 | 6/1933 | Holzwarth | 123/90.12 |
| 1,931,476 | 10/1933 | Hallett | 123/90 |
| 1,994,223 | 3/1935 | Leveque | 123/90 |
| 2,011,864 | 8/1935 | Lundh | 103/37 |
| 2,019,252 | 10/1935 | Cottingham | 123/90 |
| 2,494,183 | 1/1950 | Lincoln | 121/149 |
| 2,615,438 | 10/1952 | Tucker | 123/90 |
| 2,815,012 | 12/1957 | Sampietro | 123/90 |
| 2,829,628 | 4/1958 | Smiltneek | 123/90 |
| 3,385,274 | 5/1968 | Shunta et al. | 123/90 |
| 3,405,699 | 10/1968 | Laas | 123/97 |
| 3,490,423 | 1/1970 | Shunta et al. | 123/90 |
| 3,518,976 | 7/1970 | Thuesen | 123/90.16 |
| 3,612,015 | 10/1971 | Hausknecht | 123/90.12 |
| 3,727,595 | 4/1973 | Links | 123/90.12 |
| 4,020,806 | 5/1977 | Aoyama et al. | 123/90.55 |
| 4,033,304 | 7/1977 | Luria | 123/90.15 X |
| 4,134,371 | 1/1979 | Hausknecht | 123/90.43 |
| 4,150,640 | 4/1979 | Egan | 123/90.15 X |
| 4,153,016 | 5/1979 | Hausknecht | 123/90.15 |
| 4,408,580 | 10/1983 | Kosuda et al. | 123/90.16 |

FOREIGN PATENT DOCUMENTS

| | | | |
|---|---|---|---|
| 2448311 | 4/1976 | Fed. Rep. of Germany | 123/90.12 |
| 47909 | 9/1979 | Japan | 123/90.46 |
| 821799 | 10/1959 | United Kingdom | 123/90.12 |
| 1224168 | 3/1971 | United Kingdom | 123/90.12 |
| 1399813 | 7/1975 | United Kingdom | 123/90.55 |

*Primary Examiner*—William R. Cline
*Assistant Examiner*—Peggy A. Neils
*Attorney, Agent, or Firm*—Reese Taylor

[57] ABSTRACT

A variable valve control system includes sensors for sensing internal combustion engine operating variables such as carburetor vacuum, intake manifold vacuum, etc., and translating such variables to control a piston in a hydraulic valve control mechanism so as to ultimately vary the valve action. The piston is positioned so as to control the hydraulic pressure acting on the top of an operating sleeve which, in turn, controls upward movement of a fulcrum to control rocker arm movement and, thereby, the opening of the combustion chamber intake valve. The system includes a pivotable rocker arm, one end of which is operatively connected to the camshaft by a cam follower and push rod and the other end of which is operatively connected to the intake valve. Variably positioning the hydraulic piston, and thereby the sleeve which acts on the fulcrum, controls the movement of the rocker arm. The invention also includes an air bleed and pressure relief in the line leading from the piston to the hydraulic pressure system which is sensitive to oil viscosity and prevents local back pressure build-up in cold weather. The invention also includes a dampener system for reducing the closing velocity of the valve. This dampener system is actuated by oil from the basic system and also exhausts oil through the relief port just mentioned. The dampener is adjustable so as to offer resistance to valve closing only at the very last moment thereby reducing closing velocity.

9 Claims, 4 Drawing Figures

VARIABLE VALVE CONTROL SYSTEM WITH DAMPENER ASSEMBLY

FIELD OF THE INVENTION

This invention, in general, relates to intake and exhaust valves of internal combustion engines and, in particular, relates to the control and time of the valves so as to make them variable during each cycle of engine operation in response to varying engine conditions.

DESCRIPTION OF THE PRIOR ART

This invention is generally intended to reduce automotive engine fuel consumption, particularly during partial load and idle conditions, by varying valve timing and the amount of valve lift in the engine.

Applicant's own prior art patents, such as particularly U.S. Pat. No. 4,134,371, are directed to means for achieving this same objective.

It is well settled in the art that the potential of variable valve timing for improving performance and reducing emissions in internal combustion engines is substantial.

One of the reasons for this is that if the valve overlap, i.e., the time during which the intake and exhaust valves are both open, is eliminated, particularly at low engine speed, the volumetric efficiency at those speeds in considerably increased. Variable valve timing also make it possible to increase the turbulence in the compressed air-fuel charge so as to enhance combustion. In most fixed valve engines, turbulence increases with engine speed. However, with variable timing it is possible to increase this turbulence even at low speeds.

As noted above, Applicant's earlier U.S. Pat. No. 4,134,371 discloses means for obtaining both of these desirable results.

That invention disclosed a varialbe control mechanism for regulating the opening of the valves during each cycle of operation. The control mechanism essentially included hydraulic restraint means controlling the relationship between camshaft movement and valve opening. Essentially that restraint means included a pivotable rocker arm, one end of which was operatively connected to the camshaft by a cam follower and push rod and the other end of which was operatively connected to the intake valve. Effective movement of the rocker arm to actuate the valve was controlled by a hydraulic system, including a movable sleeve, the operation of which was controlled by varying hydraulic pressures so that by increasing or decreasing the hydraulic pressure on the sleeve, the movement of the rocker arm, and thus the opening of the valve, could be controlled and altered or varied. That patent also discloses eliminating the rocker arm and controlling opening of the valve strictly hydraulically by varying the timing between camshaft movement and the transfer of hydraulic pressure to the valve.

These solutions to the variable valve timing problem have proved satisfactory.

However, it is believed that those basic concepts can be improved upon, particularly by providing a means for avoiding excessive back pressure in the system in cold weather start up operation and in dampening the control so as to reduce the closing velocity of the valve, thereby providing a quieter operation.

SUMMARY OF THE INVENTION

Assuming then a variable valve control system of the type described in Applicant's earlier patents and referred to above, it has been found that oil viscosity sensitivity can be compensated for by providing an air bleed and pressure port in the line leading from the piston arrangement to the hydraulic cylinder which controls the movable sleeve and thus the movement of the rocker arm. This will prevent a local back pressure build up in the system, especially during cold weather operation. It also assures fast response to control valve inputs.

It has also been found that dampening or noise reduction can be achieved by providing a hydraulic dampener assembly to reduce the closing velocity of the engine intake valve. The dampener is actuated by oil from the basic variable valve control system itself and exhausts such oil through the relief port. This dampener is adjustably mounted on studs so as to offer resistance only to valve closing at the very last moment of closing and can be adjusted to achieve the desired degree of silence with the object being, of course, to slow down the valve closing to eliminate the attendant shock and noise.

Accordingly, production of a variable valve control system of the type above described becomes the principal object of this invention with other objects thereof becoming more apparent upon a reading of the following brief specification considered and interpreted in view of the accompanying drawings.

OF THE DRAWINGS

DESCRIPTION OF THE PREFERRED EMBODIMENTS

Figure 1:
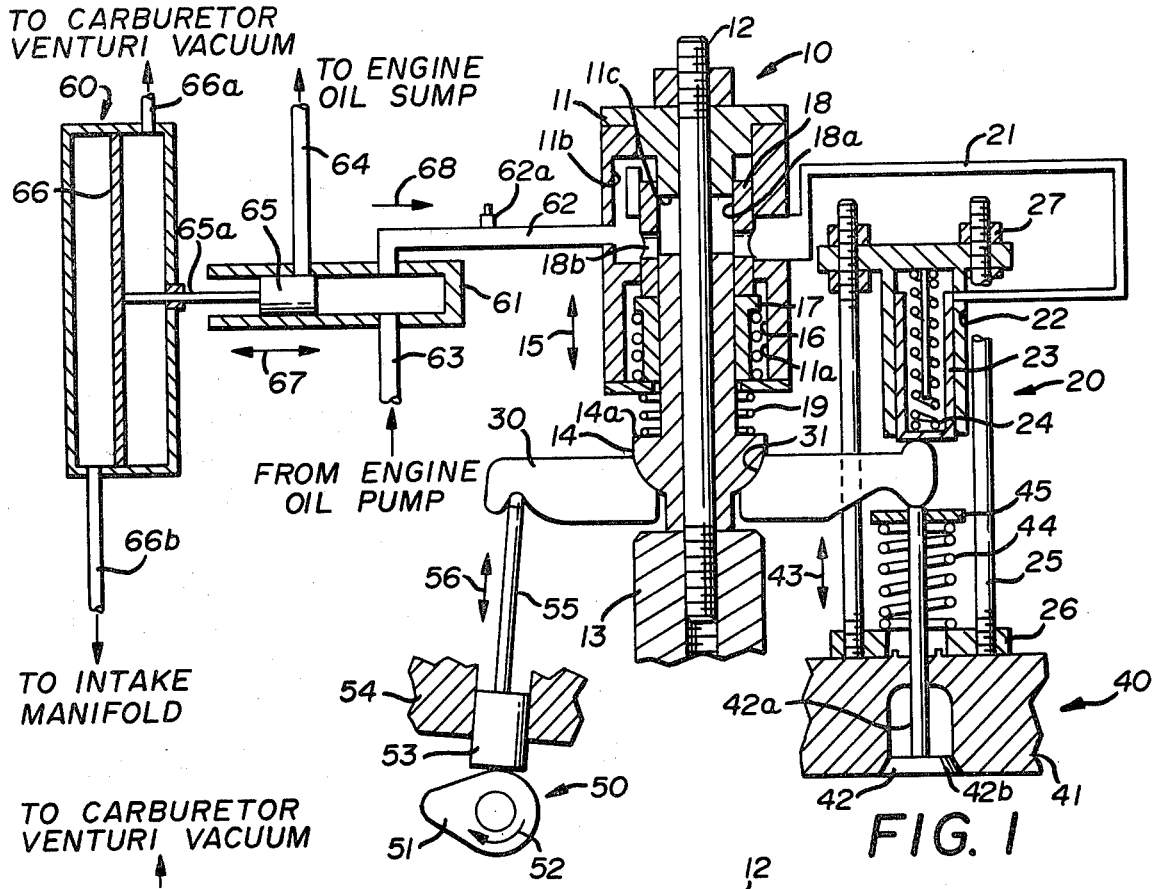
FIG. 1 is a sectional view, partially in schematic form, showing the preferred form of the invention prior to operation and set for maximum valve opening.

Referring first then to FIG. 1 and also to Applicant's earlier U.S. Pat. No. 4,134,371, it should be noted that much of the mechanism illustrated and described herein is common to the earlier disclosure.

Thus, The main components of the overall control system are a hydraulic valve assembly 10, a dampener assembly 20, a rocker arm 30, engine valve assembly 40, a cam and cam follower assembly 50, and a control assembly 60.

Turning first then to the engine valve assembly 40, it will be seen that this is essentially a conventional valve including a housing 41 and an intake valve 42 which is comprised of a valve stem 42*a* and a valve head 42*b*. The valve 42 is, of course, capable of movement from the closed position of FIG. 1 to the open position of FIG. 2 to permit fuel to enter the cylinder as will be described in greater detail. Also associated with the engine valve assembly 40 is a spring retainer 45 carried by the top of the valve stem 42*a* and a spring 44 surrounding the valve stem between retainer 45 and housing 41 and serving to normally urge the valve head 42 into the closed position of FIG. 1.

The cam and cam follower assembly 50 is also essentially conventional in nature in that it includes a cam 51 mounted on the engine camshaft for rotational movement in the direction of arrow 52. The cam follower 53 is reciprocally received in housing 54, rides on the cam 51 and is movable linearly in the direction of arrow 56 so that as the cam rotates, it will move the cam follower in conventional fashion. Cam follower 53, of course, has the usual push rod 55 connected thereto with one end of the push rod contacting the rocker arm 30 so that movement of the cam follower 53 in the upward direction will cause the rocker arm 30 to pivot such as from the position of FIG. 1 to the position of FIG. 2.

The essence of Applicant's earlier invention was to control the relative movement between the cam follower 53 and the valve 42 by permitting the rocker arm 30 to move upward in the direction of the arrow 15 a controlled distance before such movement is restrained and the arm is permitted to pivot to open the valve. In essence, the pivot point of the rocker arm 30 was adjustable and thereby the opening of the intake valve was varied.

In order to achieve that object, the hydraulic valve assembly 10 and the hydraulic control assembly 60 are employed.

The control assembly 60 includes a housing 61 with a line 62 running from the housing to the hydraulic valve assembly 10. It is in this line that the release port **62*a*** is provided in the present invention for purposes which will be described below.

A line 63 runs from the housing 61 to the engine oil pump and a line 64 runs from the housing to the engine oil sump. Neither of these components are illustrated herein, being well known to those skilled in the art.

Reciprocally received within the housing 61 is a piston 65 mounted on the end of a piston arm **65*a*. Movement of the piston 65 in the direction of the arrow 67 is controlled by a vacuum diaphragm 66 which is actuated by the carburetor venturi vacuum and the intake manifold vacuum which connect to the diaphragm 66 by the lines 66*a* and 66*b*. These vacuum conditions are operating in opposition to each other and serve to actuate the diaphragm 66. In other words, as the piston 65 is moved to the right of FIG. 1 and passes line 64 closing it off, oil from the engine oil pump is forced into the valve asssembly 10 under full pressure. When the piston retracts opening line 64, the hydraulic pressure built up in the valve assembly 10** is reduced and some of the oil is permitted to return to the sump.

The port **62*a*** prevents any back pressure build-up in this system at this time. The operative effect on the engine intake valve timing will be discussed below.

Turning next then to the hydraulic valve assembly 10, it will be noted that this assembly generally includes a housing 11 having an elongate rod 12 centrally disposed therein and passing completely through the housing. One end is received in the engine housing 13 and is fixed thereto. Essentially all that is required to retrofit an existing engine is to thread the original rocker arm stud bore in the engine housing 13 to receive the threaded end of the shaft 12.

A bell shaped fulcrum member 14 is slidably received on the rod 12 and is reciprocal along the axis thereof in the direction of the arrow 15. It should also be noted that the rocker arm 30 has a contoured central aperture 31 which seats against the bottom of the fulcrum member 14 so that movement of the rocker arm 30, as will be described below, will also result in movement of the fulcrum member 14 in the direction of arrow 15.

The housing 11 has a first central bore **11*a* which contains a spring 16. This spring has one end seated against the bottom of the housing 11. A flanged bushing 17 is slidably carried on the fulcrum member 14 and the remaining end of the spring 16 is seated against the bottom flange of that bushing so that the spring 16 will normally urge the bushing 17 away from the bottom of housing 11**.

An operating sleeve 18 is also contained in the housing 11. This sleeve is an elongate cylindrical member having an axial central opening **18*a* and a radial opening 18*b*. The sleeve 18 is telescoped on fulcrum member 14 within the valve body 11. The spring 16 and bushing 17 prevent the sleeve 18 from moving in an uncontrolled fashion to the bottom of the housing 11** and will serve to retain it within the housing.

A second spring 19 is also employed in surrounding relationship to the fulcrum member and rests against outer surface of the bottom of the housing 11 and on top of the ledge **14*a* of the fulcrum member 14. This spring will tend to force the fulcrum member to the position shown in FIG. 1** unless the force of the spring is overcome as will be described.

It will also be noted that valve housing 11 has a second internal bore **11*b* disposed axially above the first bore 11*a*. This bore is in communication with the line 62. In this fashion, oil forced into the line 62 by the engine oil pump will flow into the valve housing 11 and particularly into the bore 11*b* thereof so as to act on top of sleeve 18. Some of the oil will also flow through radial opening 18*b* and fill the space within the sleeve between the sleeve and the rod 12. FIG. 1 shows the position of the components with line 64 closed by piston 65 and maximum pressure in the line 62 wherein the sleeve 18 is forced all the way down to the limit permitted by the bushing 17**.

This mechanism, which is essentially illustrated and described in Applicant's earlier U.S. Pat. No. 4,134,371, operates as follows.

Assuming the apparatus to be in the position shown in FIG. 1, as the cam 51 moves about its axis it will drive the cam follower 53 and push rod 55 upwardly in the direction of arrow 56. If the rocker arm fulcrum 14 were fixed, this would normally cause the rocker arm 30 to immediately pivot, thereby opening the valve 42. However, due to the fact that the fulcrum member 14 is slidable on the rod 12, it is possible for it to move upward in the direction of the arrow 15 for a variable distance before that pivoting takes place. The amount of such upward movement, and hence the timing of the pivoting and the opening of the valve, is controlled by the location of the aperture **18*b* on sleeve 18**.

In this regard, as the fulcrum member 14 moves upward, some of the oil contained within the sleeve can escape through the radial opening **18*b*. However, once the fulcrum member 14 has moved upward a sufficient distance to close off the opening 18*b*, the hydraulic fluid or oil contained between the top of the fulcrum member 14 and the bottom 11*c* of the top of the housing 11 will be trapped in that space and will resist and, in fact, stop further upward movement of the fulcrum member 14**.

Figure 2:
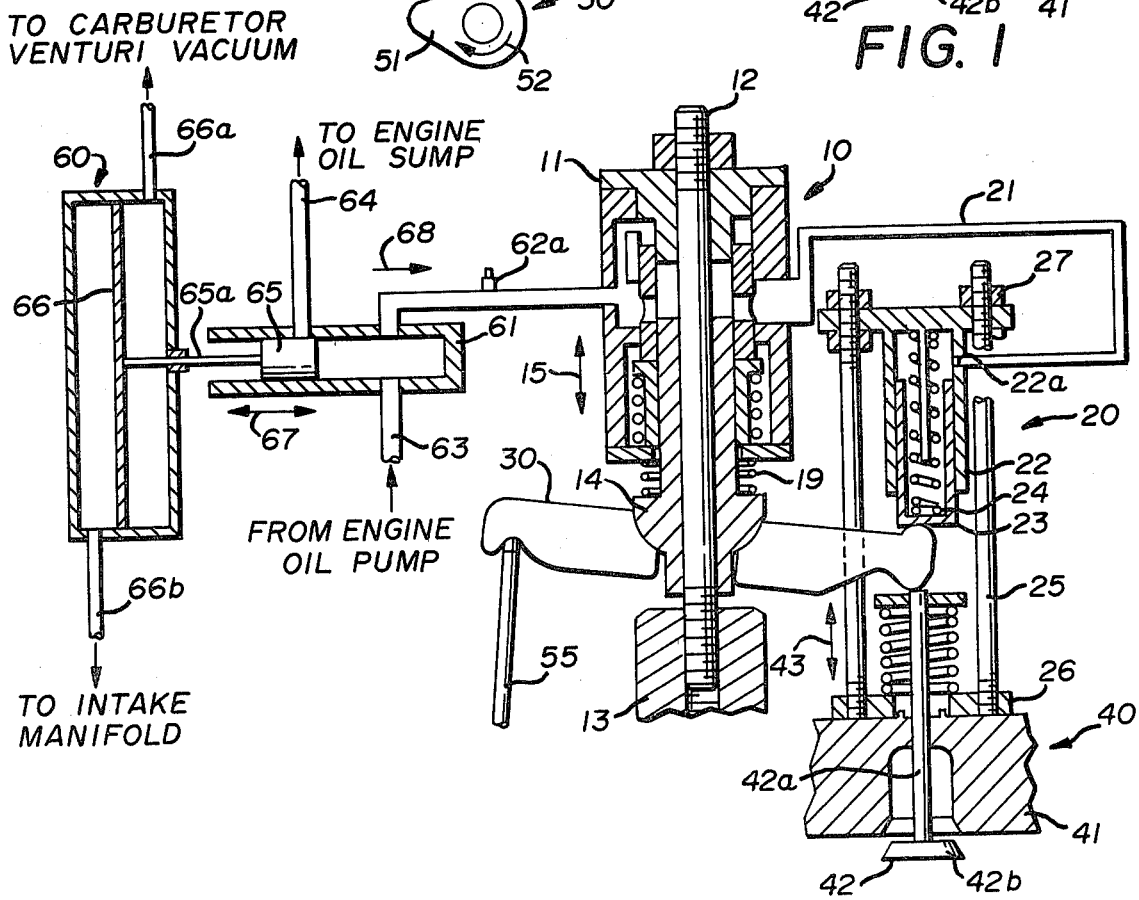
FIG. 2 is a view similar to FIG. 1 showing the preferred form of the invention during operation thereof.

Assuming the cam 51 to be continuing its rotational movement at this time, the rocker arm 30 will pivot on the fulcrum member 14 as shown in FIG. 2, driving down the valve stem **42*a* and head 42** and opening the intake valve.

The amount of pressure and degree of movement can be controlled by the diaphragm 66 in response to pressures in the carburetor venturi and intake manifold. This, of course, ultimately controls the location of the sleeve 18 and the valve timing.

As the cam 51 continues in its normal motion, pressure on the end of the rocker arm 30 will begin to be relieved once the cam passes its midpoint and, at that point, the spring 44 will begin to close the valve while the spring 19 will begin to urge the fulcrum member 14 and the rocker arm itself back to the position of FIG. 1.

It has been found that at least two improvements can be achieved over the just described structure of U.S. Pat. No. 4,134,371.

First, as already noted, the air bleed and pressure relief port 62*a* permits efficient operation in cold weather. The oil viscosity which, of course, will be altered by ambient temperature can be compensated for by this pressure relief port without affecting normal operation to avoid a high pressure spike or build-up in cold weather.

The size of port 62*a* is important in a relative sense. That is to say that if the opening is too large, too much pressure will be lost in the system and if it is too small, there will be too much back pressure. The invention is not intended to be limited to any particular size but an example which has been found appropriate is an opening of 0.03125 inches with an engine using 10/W/40 motor oil. Obviously, the operating oil pressure of the particular engine and the viscosity of the oil will affect the size requirements with a viscosity of the oil being the controlling variable. Such a determination should be within the skill of those knowledgeable in the art.

A second improvement can also be achieved by adding the dampener 20 to the system.

To that end, it will be noted that the dampener assembly 20 is connected to the housing 11 and thus to the oil by the line 21. That line 21 leads to a cylinder 22 which contains within it a piston 23. Also received within the piston 23 is a spring 24, one end of which rests on the bottom of the piston and the other end of which rests against the inner surface top of the housing or cylinder 22.

A plurality of studs 25 are adjustably connected to the top of the housing 22 and carry a bottom plate 26 on their ends.

The object of this apparatus is to slow down the closing rate of the valve 42 independently of the profile of the cam and the normal operation of the cam, cam follower, and rocker arm.

The dampener 20, as noted, is ajustable to only offer resistance to valve closing at the very last moment. Therefore, engine valve closing is positive even at low temperatures as the control system pressure is lower than that generated by the valve spring. Accordingly, when operating the mechanism, as the valve is opening in response to pivoting of the rocker arm 30, the piston 23 simply follows the rocker arm down, as can be seen in FIG. 2 of the drawings. However, as this movement occurs, the port 22*a* is opened and oil is permitted to enter into the cylinder 22 from the line 21.

Once the cam 51 moves past top center and the rocker arm begins to move back from the position of FIG. 2 to the position of FIG. 1, there will be resistance by the oil in cylinder 22 to the upward movement of the piston 23 and the pressure or resistance increases as the piston moves further upward. Effectively, this slows down the rate of closing of the valve 42 and the slower the valve closes the quieter the operation of the engine.

It also ought to be noted here that the studs 25 are threaded and secured to the top of the housing 22 by nuts 27. Therefore, the actual position of the pot 22*a*relative to the rocker arm and the valve can be adjusted until the desired closing is achieved. Thus, the valve closing rate can be controlled independently of the cam profile.

It also should be noted that the plate 26 is not attached to the valve housing 41 and is normally held down by the force of the valve spring 44 on the plate. This makes it possible for this plate and, of course the overall assembly 20, to rock slightly in the same plane as the rocker arm 30 which is particularly advantageous during cold weather operation. In cold weather, the increase in oil viscosity can lead to undesired resistance to closing leading to the valve hanging open. This free association of dampener 20 permits self compensation for such an increase in oil viscosity, particularly when it is noted that dampener 20 is slightly off center.

Figure 3:
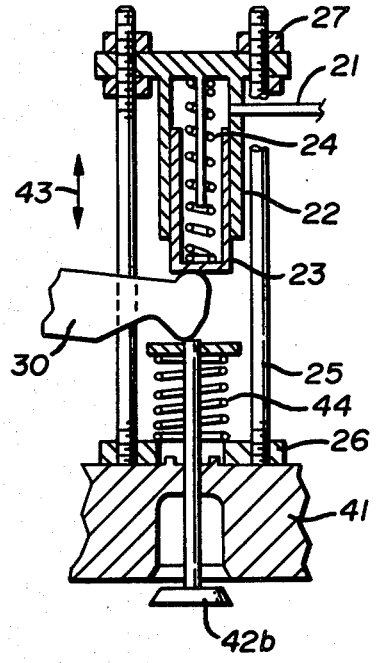
FIG. 3 is a sectional view showing the dampener in one operational position.
Figure 4:
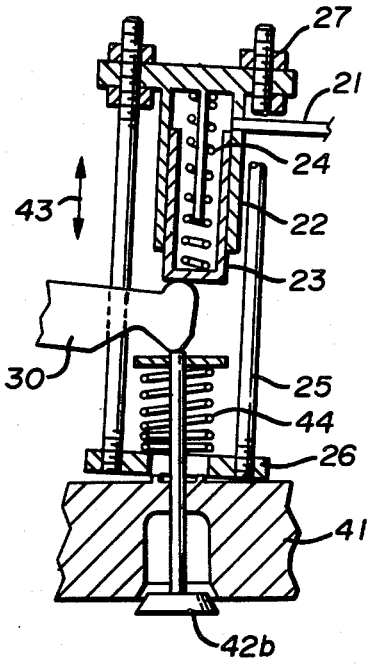
FIG. 4 is a sectional view showing the dampener in a different operational position.

Thus, referring to FIGS. 3 and 4, a parallelogram is formed by the top of the housing, plate 26, and studs 25. It will be seen that as rocker arm 30 moves up toward housing 22, the parallelogram is slightly tilted (compare FIGS. 3 and 4). This advances closing of valve 42 slightly and compensates for the increased oil viscosity under certain conditions. It should be noted that the tilting movement is exaggerated in the drawings for purposes of illustration.

Accordingly, it will be seen that a variable valve timing mechanism has been disclosed which is relatively simple and achieves a combination of effects and which can be easily retrofitted to existing engines without major engine rework. The combination of control devices and mechanisms described herein makes it possible to reduce fuel consumption by reducing valve overlap during partial load and idle operations and to also reduce fuel consumption and emissions by increasing turbulence during partial load and idle operation. This is accomplished with a rather simple, mechanical and hydraulic mechanism which, nevertheless, is quite effective for the purposes for which it is designed. Furthermore, these objectives can be achieved while avoiding any difficulties in cold weather operation and by providing means for adjustment so as to achieve a quiet running engine while still achieving the above noted advantages.

While a full and complete description of the invention has been set forth in accordance with the dictates of the Patent Statutes, it should be understood that modifications can be resorted to without departing from the spirit hereof or the scope of the appended claims.

What is claimed is:

1. Means for controlling the operational event of values in internal combustion engines which are activated by the conversion of the rotary motion of a cam shaft into linear motion of a cam follower, comprising:

(A) a housing having a central blind bore opening into one face thereof;

(B) a variable hydraulic system;

(C) said hydraulic system being connected to said central bore;

(D) a cylindrical sleeve slidably received within said central bore and having a radial aperture variably positionable within said bore (1) whereby fluid from said hydraulic system may be introduced into said housing to control the axial position of said sleeve;

(E) a rocker arm interconnecting the cam shaft and the valves;

(F) a control member (1) engaging said rocker arm and (2) slidably received within said sleeve and (3) movable in response to linear movement of the cam follower and rocker arm to close off said radial aperture and trap the fluid in said blind bore (a) whereby further linear movement of said rocker arm is prevented and pivotal movement is permitted;

(G) means for relieving fluid pressure in said hydraulic system;

(H) a dampener assembly freely disposed on the valve housing for limited movement relative thereto (1) in fluid communication with said variable hydraulic system and (2) in operative association with the valves;

(I) said dampener assembly being operative, in response to fluid pressure, to retard closing movement of the valves whereby the valve dampener assembly is self-compensating for changes in oil viscosity.

2. The means of claim 1 wherein said dampener assembly includes (A) a piston resting on said rocker arm;

(B) said piston following said rocker arm during opening of the valves; and (C) fluid pressure from said variable hydraulic system acting on said piston to affect the closing rate of the valves.

3. The means of claim 2 wherein the point of fluid communication between said housing and said variable hydraulic system is adjustable with respect to said valve whereby operation of said dampener assembly is adjustable to alter the closing rate of the valves.

4. The means of claim 1 wherein said dampener assembly includes (A) a housing; and (B) a piston reciprocally received within said housing and engaging said rocker arm; and (C) said housing is in fluid communication with said variable hydraulic system.

5. The means of claim 4 wherein said dampener assembly includes (A) a spring received within said housing and engaging said piston; and (B) said spring normally urges said piston toward said rocker arm.

6. The means of claim 4 wherein said piston is offset from the central axis of said valves.

7. The means of claim 4 wherein said housing and said piston are tiltable with respect to their longitudinal axes.

8. Means for controlling the operational event of valves in internal combustion engines which are actuated by the conversion of the rotary motion of a cam shaft into linear motion of a cam follower and wherein the cam followers activate rocker arms which engage the valves, comprising:

(A) a variable hydraulic system acting on the rocker arm to control the pivoting action thereof and thereby its effect on the valves;

(B) control means for varying the hydraulic pressure within said system;

(C) means for relieving pressure within said variable hydraulic system;

(D) a dampener assembly freely disposed on the valve housing for limited movement relative thereto (1) in fluid communication with said variable hydraulic system, and (2) in operative association with the valves; and (E) said dampener assembly being operative, in response to fluid pressure, to retard closing movement of the valves whereby the valve dampener assembly is self-compensating for changes in oil viscosity.

9. The means of claim 8 wherein the point of fluid communication between said dampener assembly and said variable hydraulic system is adjustable with respect to the valve whereby operation of said dampener assembly is adjustable to alter the closing rate of the valves.

* * * * *